US009180578B2

(12) United States Patent
Chen

(10) Patent No.: US 9,180,578 B2
(45) Date of Patent: Nov. 10, 2015

(54) SLEEVE STRUCTURE

(71) Applicant: Zhi-Ji Chen, Taichung (TW)

(72) Inventor: Zhi-Ji Chen, Taichung (TW)

( * ) Notice: Subject to any disclaimer, the term of this patent is extended or adjusted under 35 U.S.C. 154(b) by 191 days.

(21) Appl. No.: 13/975,375

(22) Filed: Aug. 26, 2013

(65) Prior Publication Data

US 2015/0053052 A1 Feb. 26, 2015

(51) Int. Cl.
*B25B 13/10* (2006.01)
*B25B 13/06* (2006.01)
*B25B 13/56* (2006.01)

(52) U.S. Cl.
CPC ..... *B25B 13/102* (2013.01); *B25B 13/06* (2013.01); *B25B 13/56* (2013.01)

(58) Field of Classification Search
CPC .... B25B 13/102; B25B 13/06; B25B 13/005; B25B 13/56
USPC ..... 81/124.4, 124.5
See application file for complete search history.

(56) References Cited

U.S. PATENT DOCUMENTS 1,395,528 A * 11/1921 Silva ..... 81/124.5
1,471,451 A * 10/1923 Crimp ..... 81/185
3,227,015 A * 1/1966 Tremblay ..... 81/177.2
5,157,995 A * 10/1992 Nogues ..... 81/124.5
5,251,520 A * 10/1993 Lanham ..... 81/436
5,752,418 A * 5/1998 Robins ..... 81/177.2
6,098,502 A * 8/2000 Pendergrass ..... 81/124.3
7,252,022 B1 * 8/2007 Losee ..... 81/124.5
7,387,051 B1 * 6/2008 Chiang ..... 81/124.4
8,113,093 B2 * 2/2012 Kistner ..... 81/124.5
8,684,620 B2 * 4/2014 Lin ..... 403/109.7
8,695,461 B2 * 4/2014 Moss et al. ..... 81/125
2011/0056337 A1 * 3/2011 Buchanan ..... 81/124.5
2012/0137837 A1 * 6/2012 Souma ..... 81/124.3
2014/0102261 A1 * 4/2014 Willicombe ..... 81/121.1
2014/0174263 A1 * 6/2014 Moss et al. ..... 81/125

* cited by examiner

*Primary Examiner* — David B Thomas

(57) ABSTRACT

A sleeve structure contains a body. The body includes an outer sleeve, the outer sleeve has a first fitting groove defined therein and an elongated slot formed on an outer peripheral wall thereof and communicating with the first fitting groove. The first fitting groove has a resilient element and an inner sleeve which are disposed in the first fitting groove, wherein a bottom end of the resilient element abuts against a bottom end of the first fitting groove. The inner sleeve has a second fitting groove defined therein and an orifice arranged on an outer peripheral wall thereof. The elongated slot has a connecting post inserted therein, and the connecting post connects with a driving block by ways of a coupling shaft, wherein the driving bock has a shoulder formed on at least one corner of a bottom end thereof.

6 Claims, 11 Drawing Sheets

SLEEVE STRUCTURE

FIELD OF THE INVENTION

The present invention relates to a sleeve structure which is capable of changing operating size of a sleeve.

BACKGROUND OF THE INVENTION

Conventional sleeve has a fixed size, but it cannot be applicable for different workpieces with a varying size based on using requirement.

The present invention has arisen to mitigate and/or obviate the afore-described disadvantages.

SUMMARY OF THE INVENTION

The primary object of the present invention is to provide a sleeve structure which is capable of changing operating size of a sleeve.

To obtain the above objectives, a sleeve structure provided by the present invention contains: a body. The body includes an outer sleeve, the outer sleeve has a first fitting groove defined therein and an elongated slot formed on an outer peripheral wall thereof and communicating with the first fitting groove.

The first fitting groove has a resilient element and an inner sleeve which are disposed in the first fitting groove, wherein a bottom end of the resilient element abuts against a bottom end of the first fitting groove.

The inner sleeve has a second fitting groove defined therein and an orifice arranged on an outer peripheral wall thereof. The elongated slot has a connecting post inserted therein, and the connecting post connects with a driving block by ways of a coupling shaft, wherein the driving bock has a shoulder formed on at least one corner of a bottom end thereof.

DETAILED DESCRIPTION OF THE PREFERRED EMBODIMENTS

Figure 1:
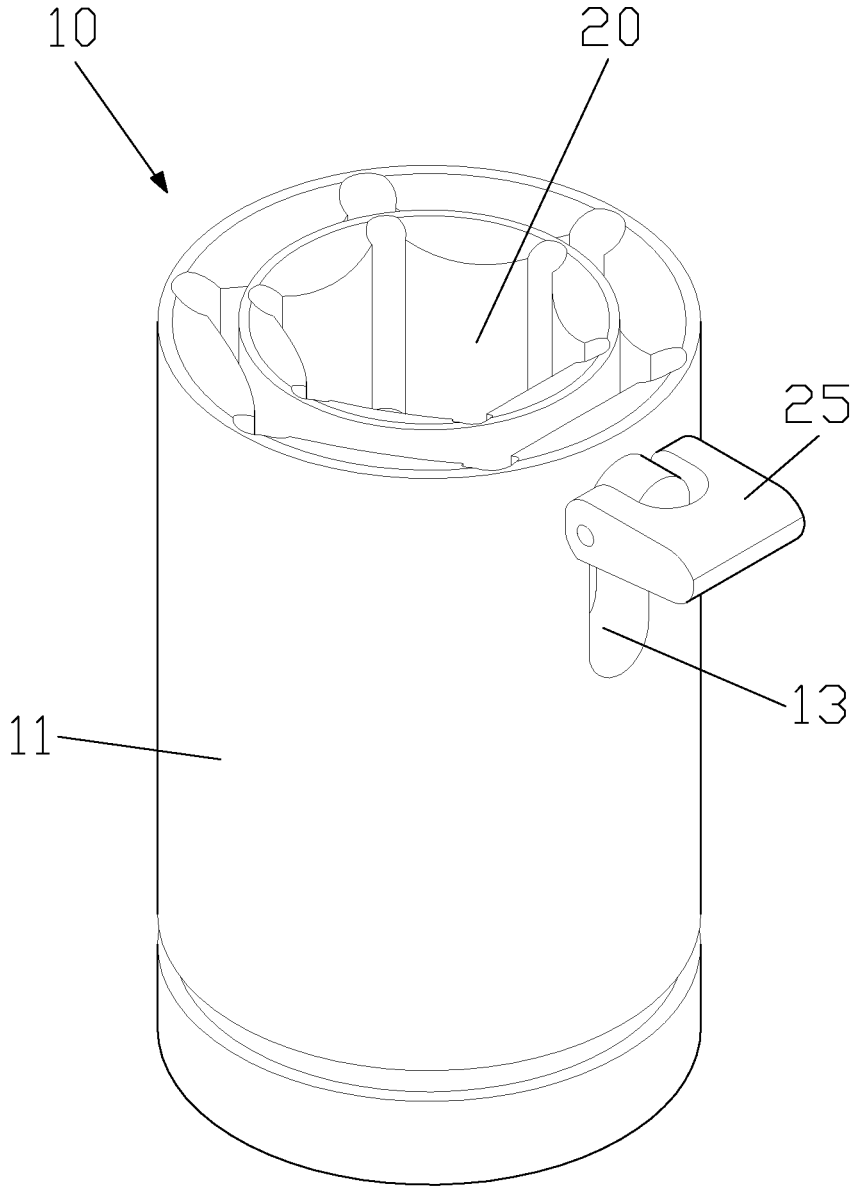
FIG. 1 is a perspective view showing the assembly of a sleeve structure according to a first embodiment of the present invention.
Figure 2:
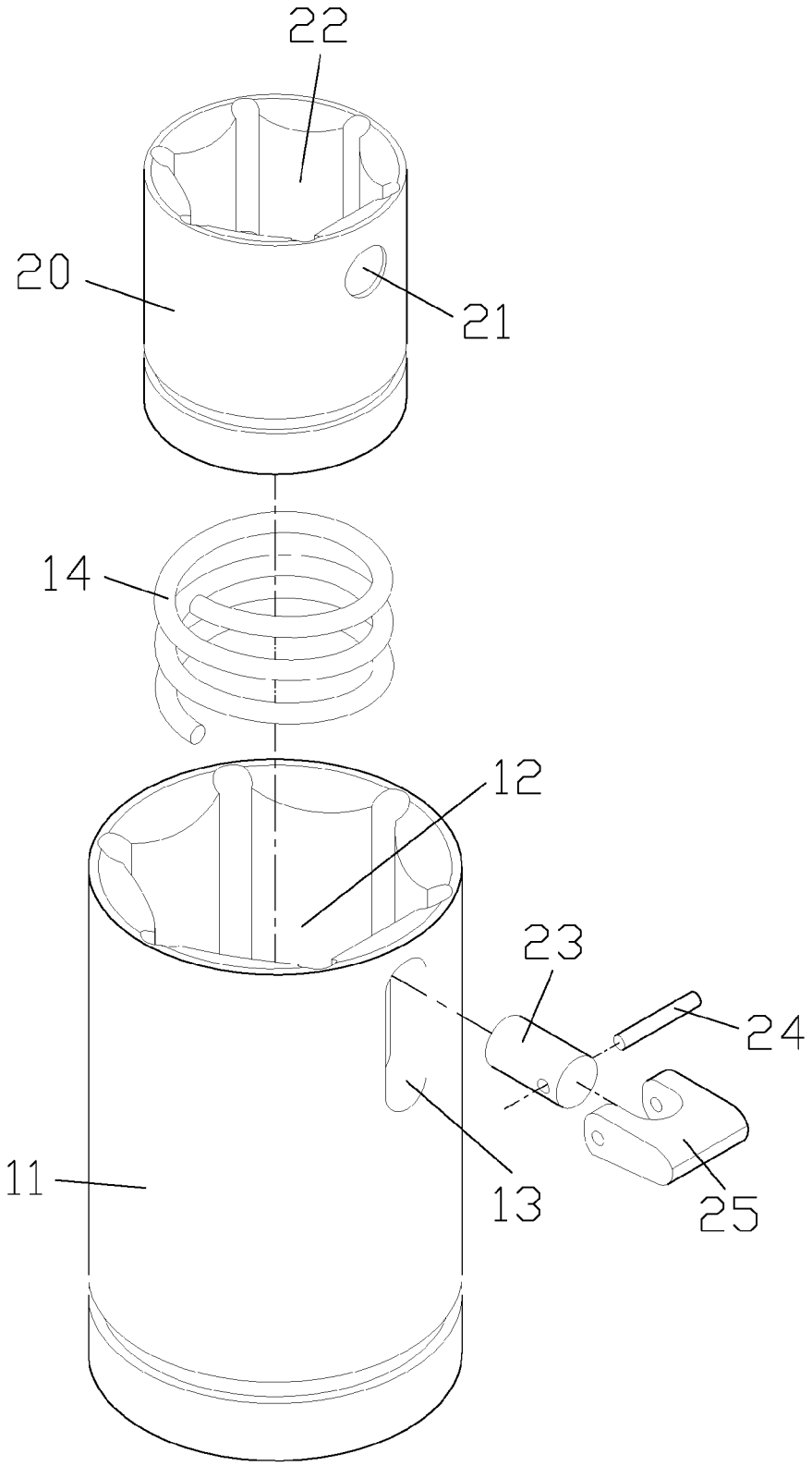
FIG. 2 is a perspective view showing the exploded components of the sleeve structure according to the first embodiment of the present invention.
Figure 3:
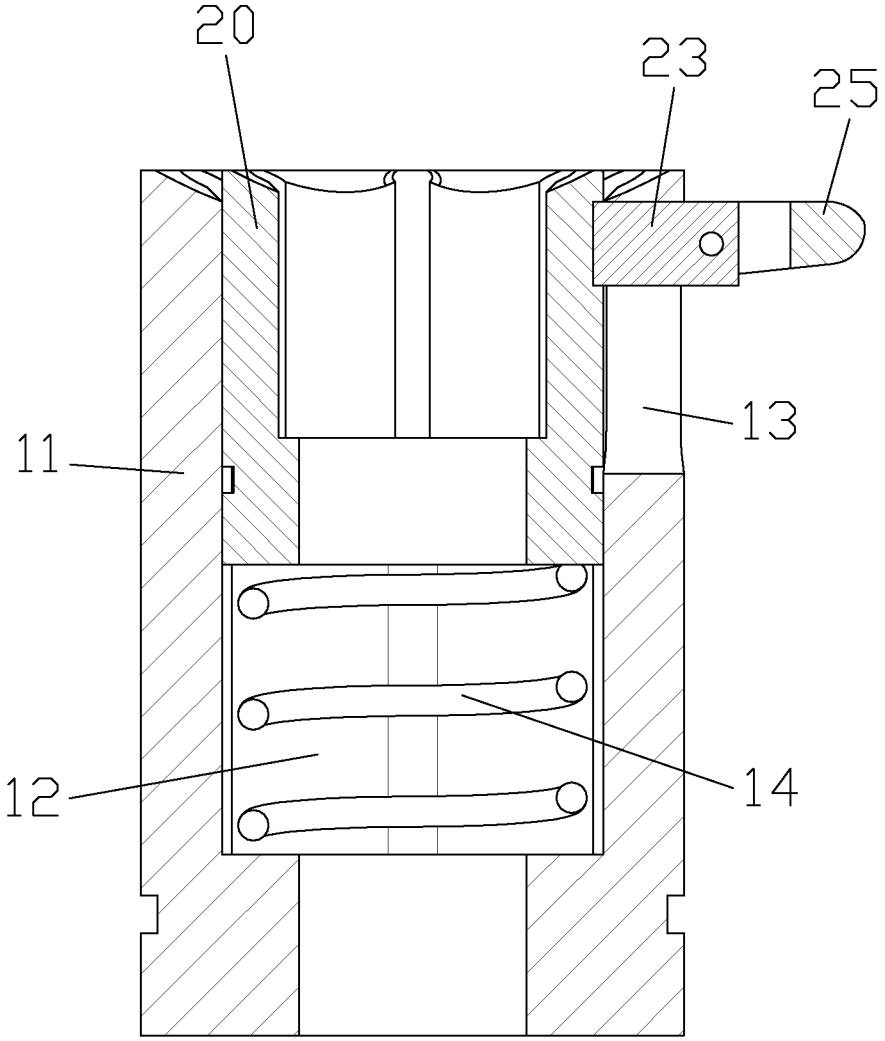
FIG. 3 is a cross sectional view showing the assembly of the sleeve structure according to the first embodiment of the present invention.
Figure 4:
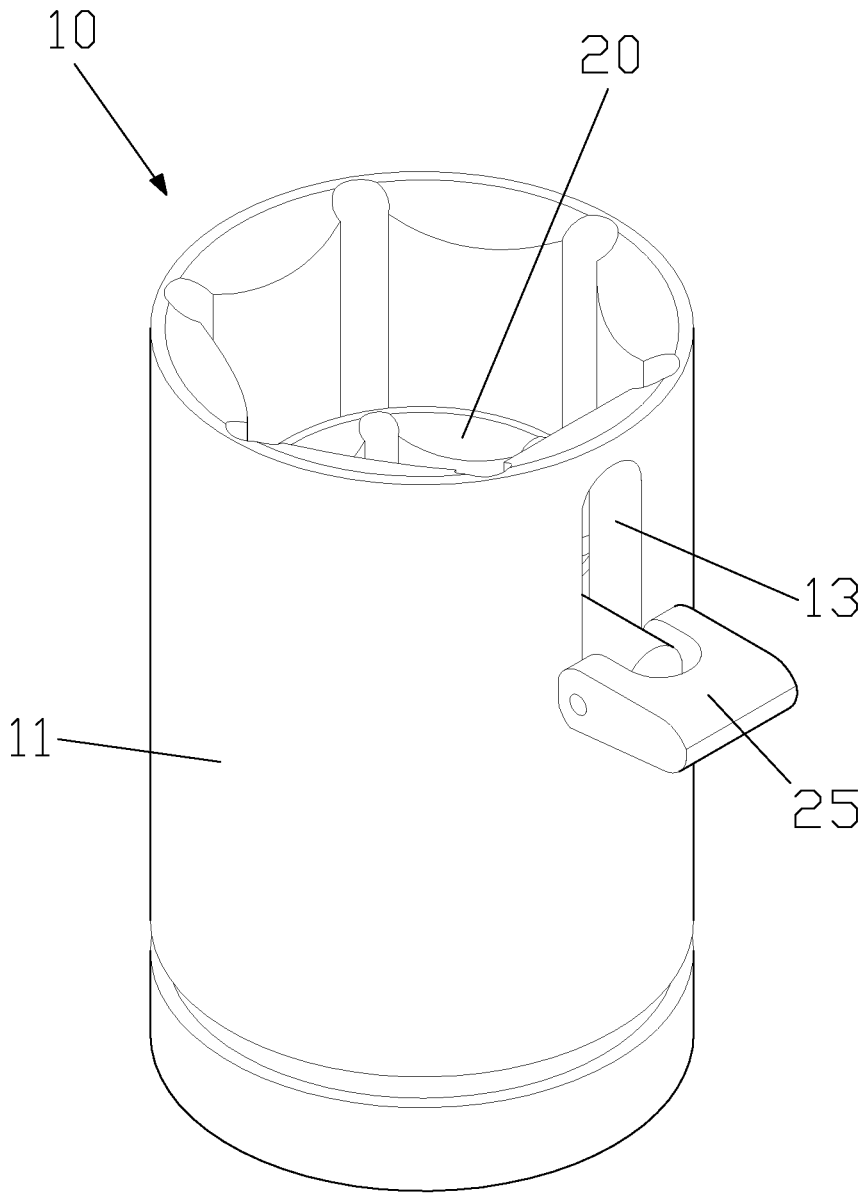
FIG. 4 is a perspective view showing the operation of the sleeve structure according to the first embodiment of the present invention.
Figure 5:
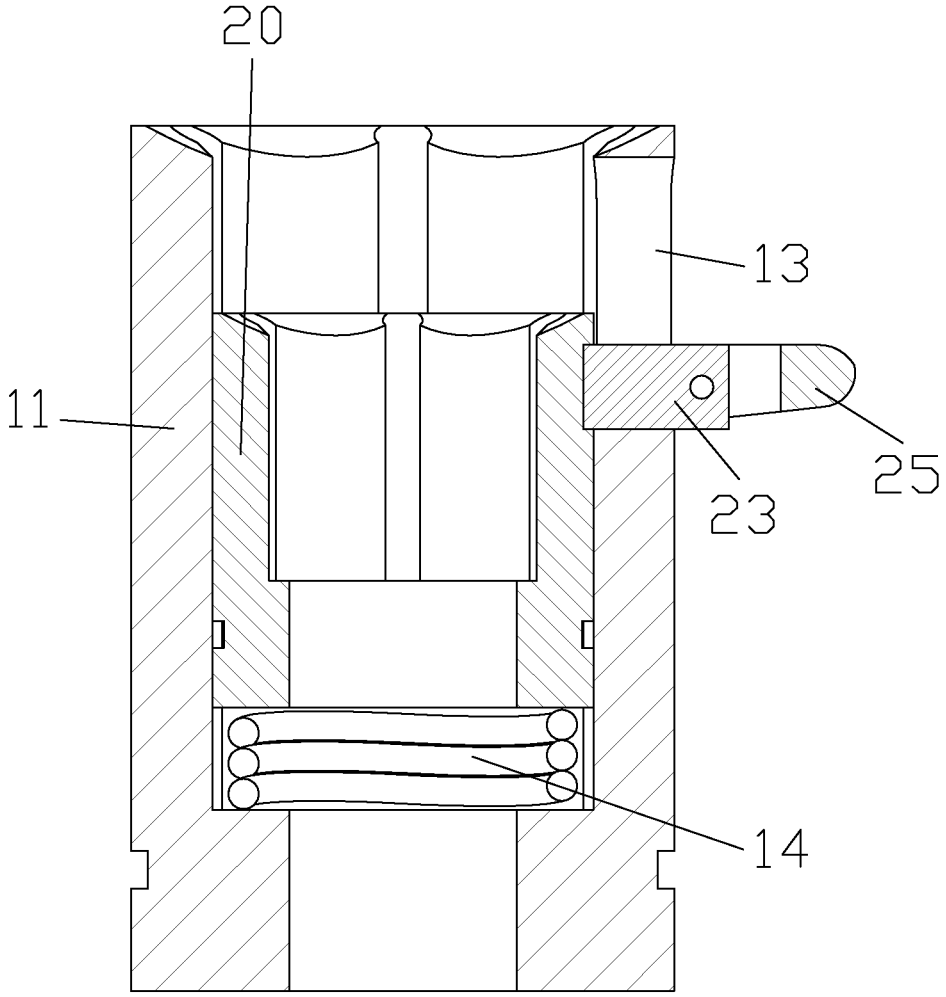
FIG. 5 is a cross sectional view showing the operation of the sleeve structure according to the first embodiment of the present invention.
Figure 6:
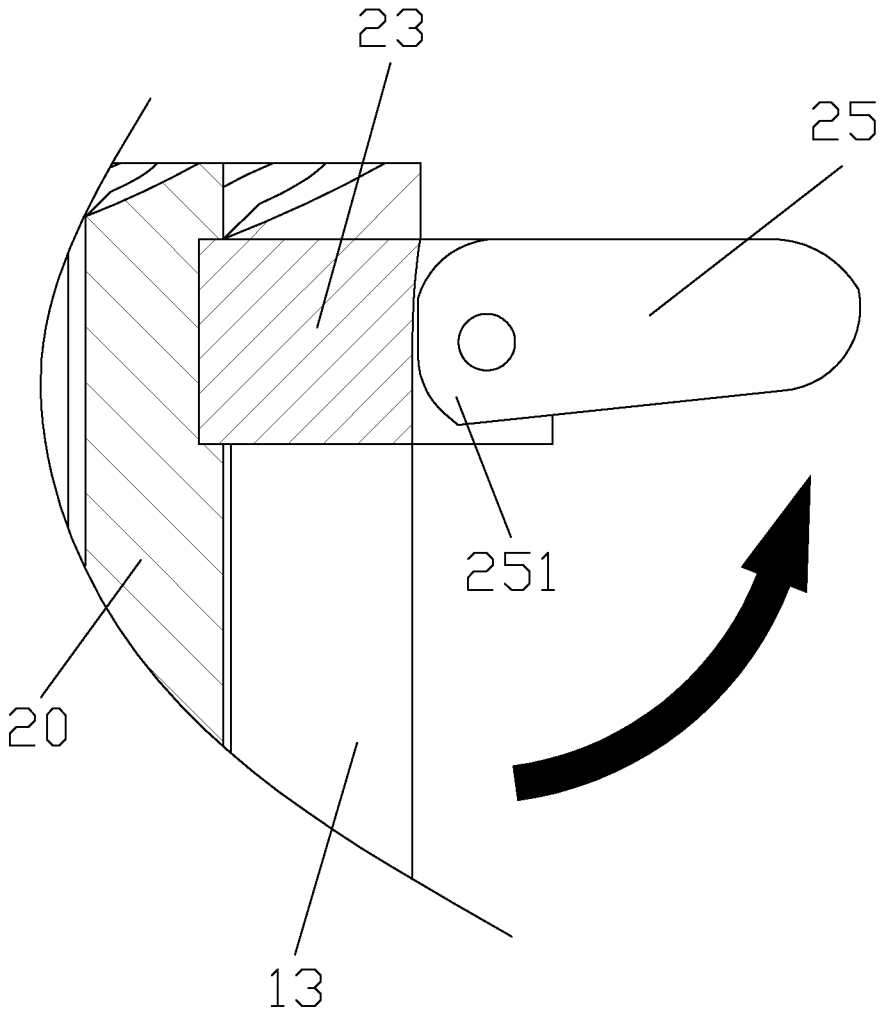
FIG. 6 is another cross sectional view showing the operation of the sleeve structure according to the first embodiment of the present invention.
Figure 7:
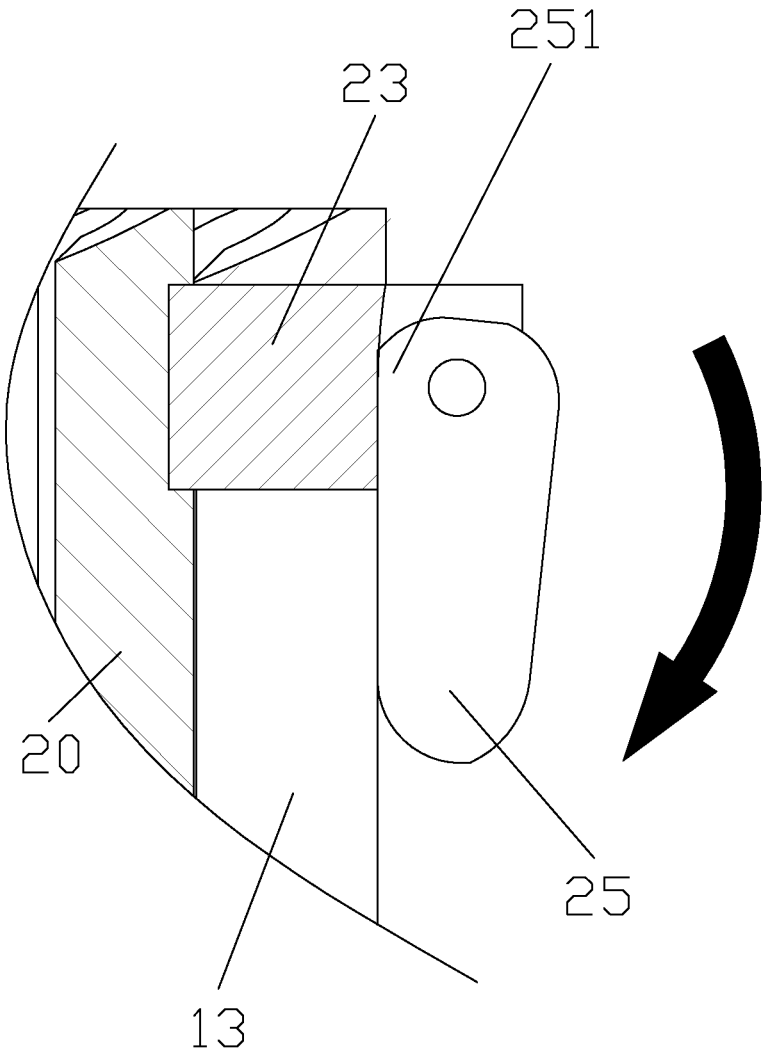
FIG. 7 is also another cross sectional view showing the operation of the sleeve structure according to the first embodiment of the present invention.

Referring to FIGS. 1-3, a sleeve structure according to a first embodiment of the present invention comprises a body 10, and the body 10 includes an outer sleeve 11, the outer sleeve 11 has a first fitting groove 12 defined therein and an elongated slot 13 formed on an outer peripheral wall thereof and communicating with the first fitting groove 12; the first fitting groove 12 has a resilient element 14 and an inner sleeve 20 which are disposed in the first fitting groove 12, wherein a bottom end of the resilient element 14 abuts against a bottom end of the first fitting groove 12; the inner sleeve 20 has a second fitting groove 22 defined therein and an orifice 21 arranged on an outer peripheral wall thereof; the elongated slot 13 of the outer sleeve 11 has a connecting post 23 inserted therein, and the connecting post 23 connects with a driving block 25 by ways of a coupling shaft 24.

Referring further to FIGS. 3 to 7, when the connecting post 23 moves in the elongated slot 13, it drives the inner sleeve 20 to move in the first fitting groove 12 of the outer sleeve 11, and the resilient element 14 pushes the inner sleeve 20 to move back to an original position. In addition the driving bock 25 has a shoulder 251 formed on at least one corner of a bottom end thereof, such that when the driving block 25 is rotated outwardly along the coupling shaft 24, the connecting post 23 and the inner sleeve 20 are released to move, and when the driving block 25 is rotated downwardly, the shoulder 251 presses the outer sleeve 11 and pulls the inner sleeve 20, such that the inner sleeve 20 is moved and positioned so that a user replaces an operating size of a sleeve.

Figure 8:
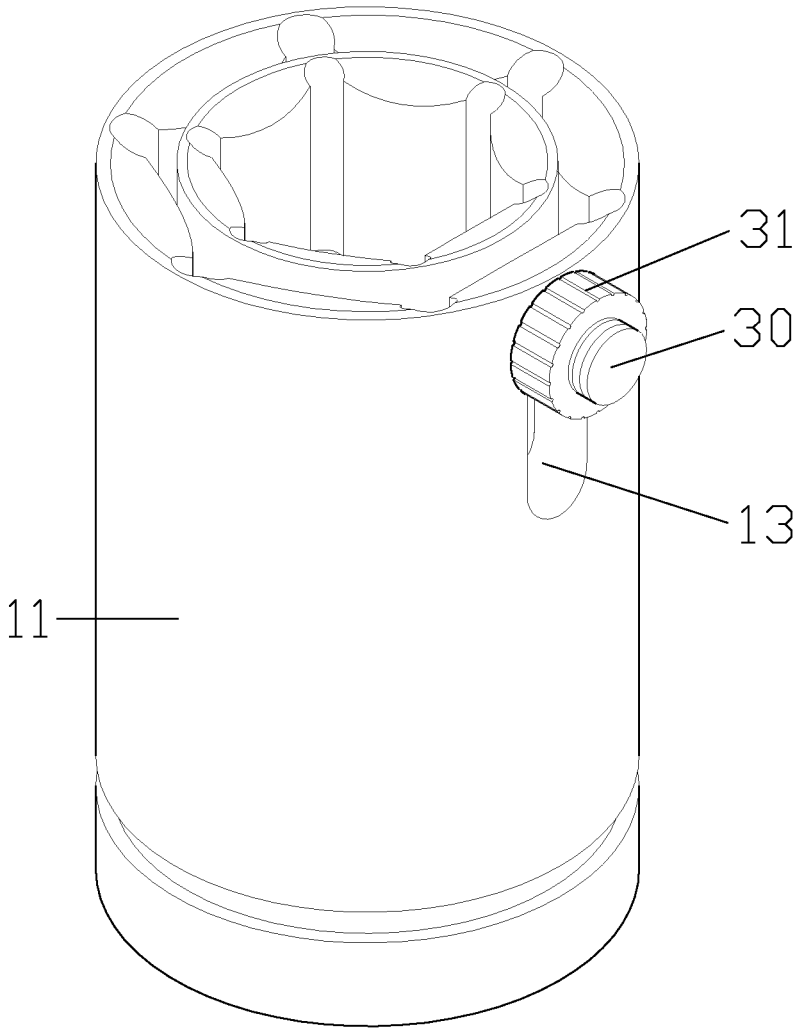
FIG. 8 is a perspective view showing the assembly of a sleeve structure according to a second embodiment of the present invention.
Figure 9:
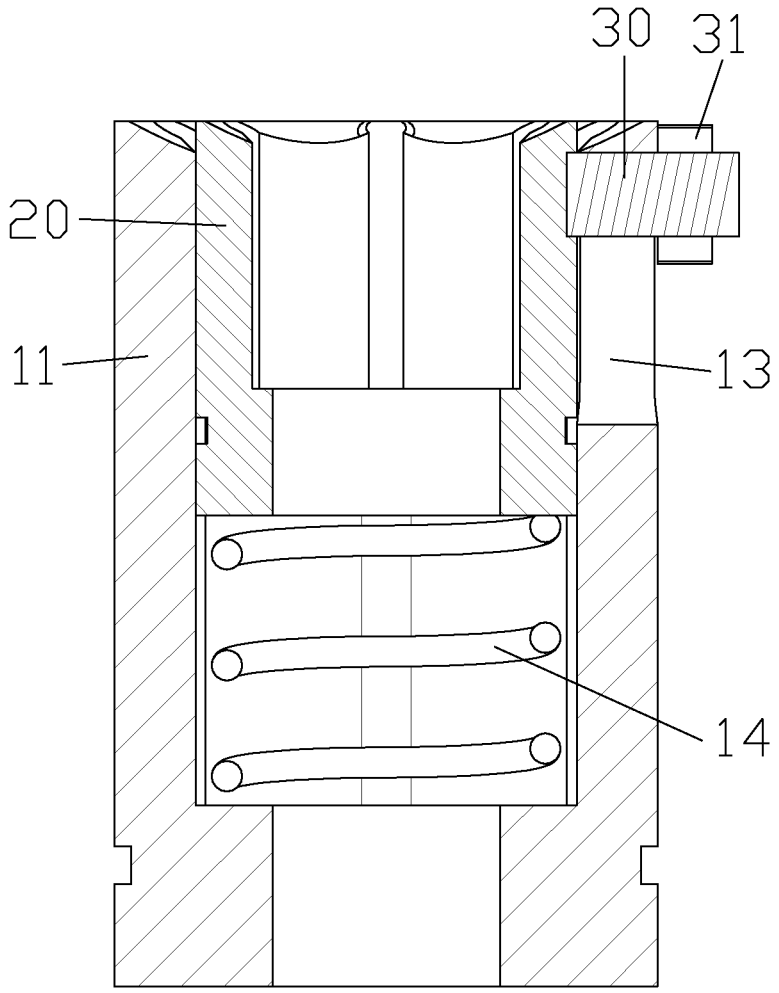
FIG. 9 is a cross sectional view showing the assembly of the sleeve structure according to the second embodiment of the present invention.

As shown in FIGS. 1, 8, and 9, a difference of a sleeve structure of a second embodiment from that of the first embodiment contains a screw rod 30 for replacing the connecting post 23 of the first embodiment and an adjusting member 31 for fastening or unfastening the screw rod 30, such that the inner sleeve 20 is fixed.

Figure 10:
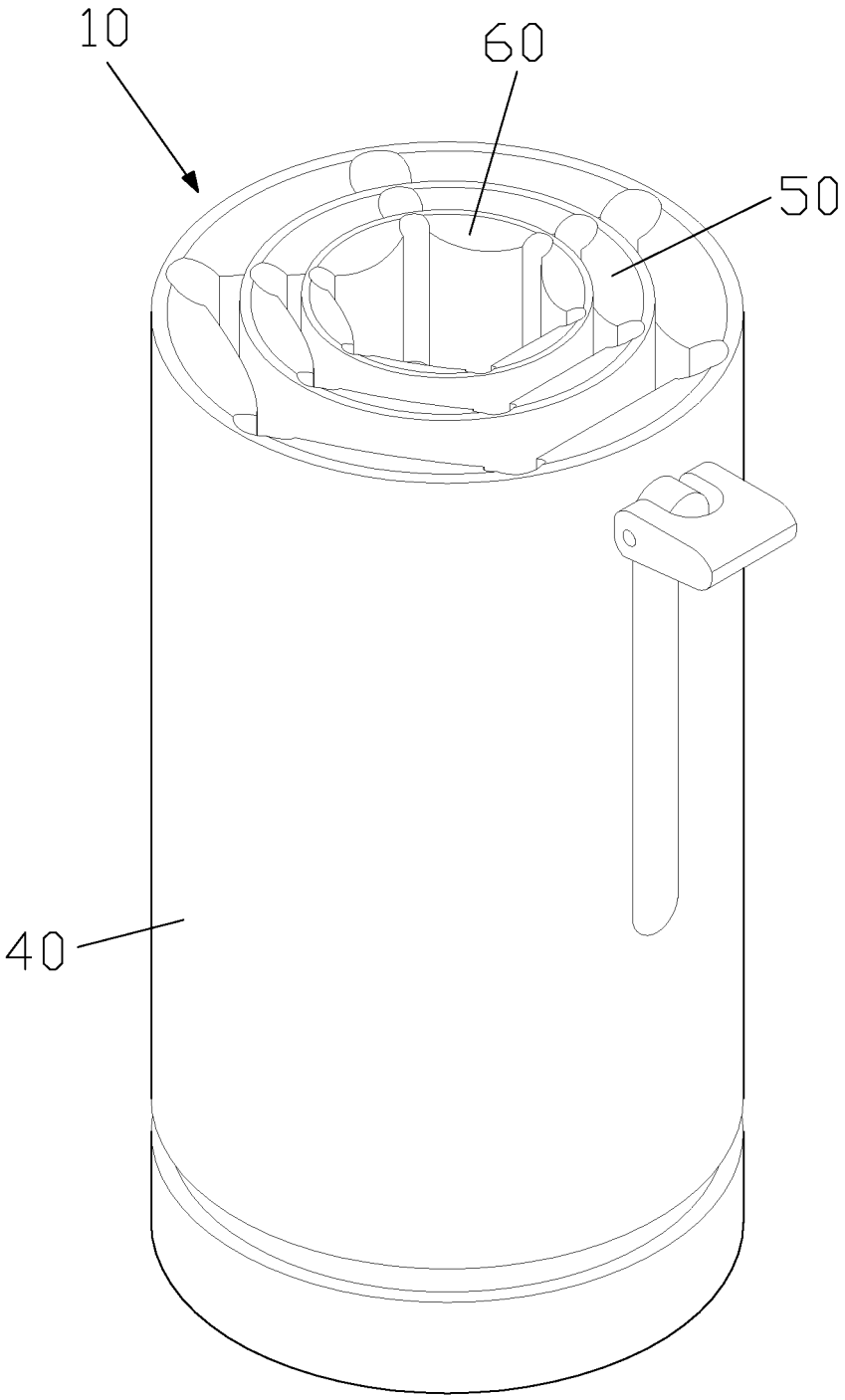
FIG. 10 is a perspective view showing the assembly of a sleeve structure according to a third embodiment of the present invention.
Figure 11:
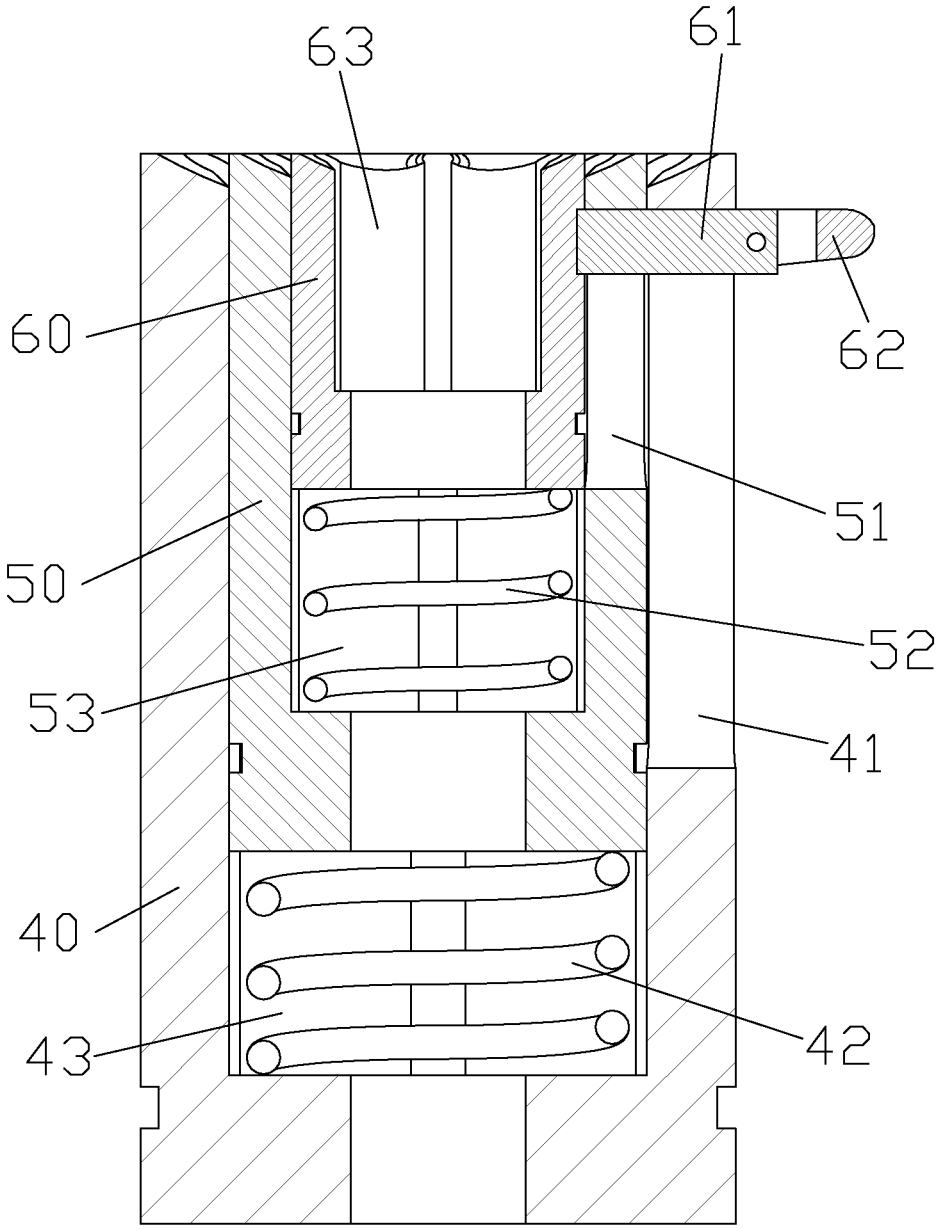
FIG. 11 is a cross sectional view showing the assembly of the sleeve structure according to the third embodiment of the present invention.

As illustrated in FIGS. 10 and 11, a sleeve structure according to a third embodiment of the present invention comprises a body 10, and the body 10 includes at least two sleeves with a varying size. For example, the body 10 includes an outer sleeve 40 with a size larger than that of the outer sleeve 11 of the first embodiment, and the outer sleeve 40 has a first fitting groove 43 defined therein and a first elongated slot 41 formed on an outer peripheral wall thereof and communicating with the first fitting groove 43; the first fitting groove 43 has a first resilient element 42 and a first inner sleeve 50 which are disposed in the first fitting groove 43, and the first inner sleeve 50 has a second fitting groove 53 defined therein and communicating with the first fitting groove 43; wherein the second fitting groove 53 has a second resilient element 52 and a second inner sleeve 60 which are disposed in the second fitting groove 53, the second inner sleeve 60 has a third fitting groove 62 defined therein; and the second inner sleeve 60 has a second elongated slot 51 defined on an outer peripheral wall thereof and corresponding to the first elongated slot 41, wherein a length of the first elongated slot 41 is longer than that of the second elongated slot 51. Furthermore, between the first elongated slot 41 and the second elongated slot 51 are defined a connecting post 61 and a driving block 62, wherein the connecting post 61 connects with the second inner sleeve 60.

Thereby, when the connecting post 61 is fixed on top ends of the first elongated slot 41 and the second elongated slot 51, the second inner sleeve 60 matches with the body 10; and when the connecting post 61 is fixed on a middle section of the first elongated slot 41 and a bottom end of the second elongated slot 41, the first inner sleeve 60 matches with the body 10; and when the connecting post 61 is fixed on a bottom end of the first elongated slot 41 and presses the first inner sleeve 50 and the second inner sleeve 60 downwardly, the outer sleeve 40 matches with the body 10.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A sleeve structure comprising:

a body, and the body including an outer sleeve, the outer sleeve having a first fitting groove defined therein and an elongated slot formed on an outer peripheral wall thereof and communicating with the first fitting groove;

the first fitting groove having a resilient element and an inner sleeve which are disposed in the first fitting groove, wherein a bottom end of the resilient element abuts against a bottom end of the first fitting groove;

the inner sleeve having a second fitting groove defined therein and an orifice arranged on an outer peripheral wall thereof;

the elongated slot having a connecting post inserted therein, and the connecting post connecting with a driving block by ways of a coupling shaft, wherein the driving bock has a shoulder formed on at least one corner of a bottom end thereof.

2. The sleeve structure as claimed in claim 1, wherein the resilient element pushes the inner sleeve to move back to an original position.

3. The sleeve structure as claimed in claim 1, wherein the connecting post is a screw rod which is fastened or unfastened by an adjusting member.

4. A sleeve structure comprising:

a body, and the body including includes an outer sleeve, the outer sleeve having a first fitting groove defined therein and a first elongated slot formed on an outer peripheral wall thereof and communicating with the first fitting groove;

the first fitting groove having a first resilient element and a first inner sleeve which are disposed in the first fitting groove, and the first inner sleeve having a second fitting groove defined therein and communicating with the first fitting groove; wherein the second fitting groove has a second resilient element and a second inner sleeve which are disposed in the second fitting groove, the second inner sleeve has a third fitting groove defined therein;

the second inner sleeve has a second elongated slot defined on an outer peripheral wall thereof, between the first elongated slot and the second elongated slot are defined a connecting post and a driving block, wherein the connecting post connects with the second inner sleeve.

5. The sleeve structure as claimed in claim 4, wherein the second elongated slot corresponds to the first elongated slot.

6. The sleeve structure as claimed in claim 4, wherein a length of the first elongated slot is longer than that of the second elongated slot.

* * * * *